US008141798B2

(12) United States Patent
Reilly et al.

(10) Patent No.: US 8,141,798 B2
(45) Date of Patent: Mar. 27, 2012

(54) HIGH VELOCITY LOW PRESSURE EMITTER WITH DEFLECTOR HAVING CLOSED END CAVITY

(75) Inventors: William J. Reilly, Langhorne, PA (US); Robert J. Ballard, Whitehall, PA (US); Stephen R. Ide, Nazareth, PA (US)

(73) Assignee: Victaulic Company, Easton, PA (US)

( * ) Notice: Subject to any disclaimer, the term of this patent is extended or adjusted under 35 U.S.C. 154(b) by 252 days.

(21) Appl. No.: 12/756,457

(22) Filed: Apr. 8, 2010

(65) Prior Publication Data

US 2010/0193609 A1 Aug. 5, 2010

Related U.S. Application Data

(63) Continuation of application No. 11/451,795, filed on Jun. 13, 2006, now Pat. No. 7,721,811.

(60) Provisional application No. 60/689,864, filed on Jun. 13, 2005, provisional application No. 60/776,407, filed on Feb. 24, 2006.

(51) Int. Cl.
*B05B 1/34* (2006.01)

(52) U.S. Cl. ..... 239/490; 239/418; 239/424; 239/518; 169/37

(58) Field of Classification Search ..... 239/406, 239/407, 398, 424.5, 425.5, 433, 424, 418, 239/490, 524, 461, 523, 518, 592–594; 169/14, 169/16, 17, 37, 43–47
See application file for complete search history.

(56) References Cited

U.S. PATENT DOCUMENTS

| | | | |
|---|---|---|---|
| 2,519,619 | A | 8/1950 | Yellott et al. |
| 3,070,313 | A | 12/1962 | Fortman |
| 3,084,874 | A | 4/1963 | Jones et al. |
| 3,108,749 | A | 10/1963 | Drayer et al. |
| 3,117,551 | A | 1/1964 | Fortman et al. |
| 3,157,359 | A | 11/1964 | Fortman |
| 3,297,255 | A | 1/1967 | Fortman |
| 3,326,467 | A | 6/1967 | Fortman |
| 3,371,869 | A | 3/1968 | Hughes |
| 3,638,859 | A | 2/1972 | MacFarlane |
| 3,741,484 | A | 6/1973 | Cresswell |
| 3,779,460 | A | 12/1973 | Monro |
| 3,829,015 | A | 8/1974 | Monro |
| 3,923,248 | A | 12/1975 | Cresswell |
| 3,934,641 | A | 1/1976 | Chielens |
| 4,103,827 | A | 8/1978 | Kumazawa |
| 4,109,862 | A | 8/1978 | Hughes |
| 4,281,717 | A | 8/1981 | Williams |

(Continued)

FOREIGN PATENT DOCUMENTS

EP 06773057.2 4/2009

(Continued)

OTHER PUBLICATIONS

PCT/US06/23013, Feb. 2007, Response to Written Opinion.

(Continued)

*Primary Examiner* — Davis Hwu
(74) *Attorney, Agent, or Firm* — Ballard Spahr LLP

(57) ABSTRACT

An emitter for atomizing and discharging a liquid entrained in a gas stream is disclosed. The emitter has a nozzle with an outlet facing a deflector surface having a closed end cavity. The nozzle discharges a gas jet against the deflector surface. The emitter has a duct with an exit orifice adjacent to the nozzle outlet. Liquid is discharged from the orifice and is entrained in the gas jet where it is atomized.

30 Claims, 4 Drawing Sheets

U.S. PATENT DOCUMENTS

| | | | |
|---|---|---|---|
| 4,361,285 | A | 11/1982 | Koppehele et al. |
| 4,408,719 | A | 10/1983 | Last |
| 4,531,588 | A | 7/1985 | Brunsicke |
| 4,871,489 | A | 10/1989 | Ketcham |
| 5,248,087 | A | 9/1993 | Dressler |
| 5,297,501 | A | 3/1994 | Lieberman et al. |
| 5,314,117 | A | 5/1994 | Pavliuk et al. |
| 5,405,085 | A | 4/1995 | White |
| 5,495,893 | A | 3/1996 | Roberts et al. |
| 5,687,905 | A | 11/1997 | Tsai |
| 5,829,684 | A | 11/1998 | Fischer |
| 5,845,846 | A | 12/1998 | Watanabe et al. |
| 5,983,944 | A | 11/1999 | Niv |
| 6,009,869 | A | 1/2000 | Corbeil |
| 6,065,546 | A | 5/2000 | Uetake et al. |
| 6,098,897 | A | 8/2000 | Lockwood |
| 6,173,790 | B1 | 1/2001 | Russwurm et al. |
| 6,261,338 | B1 | 7/2001 | Mahoney et al. |
| 6,311,780 | B1 | 11/2001 | Zuev et al. |
| 6,314,754 | B1 | 11/2001 | Kotliar |
| 6,357,531 | B1 | 3/2002 | Asselin |
| 6,390,203 | B1 | 5/2002 | Borisov et al. |
| 6,401,487 | B1 | 6/2002 | Kotliar |
| 6,418,752 | B2 | 7/2002 | Kotliar |
| 6,502,421 | B2 | 1/2003 | Kotliar |
| 6,557,374 | B2 | 5/2003 | Kotliar |
| 6,560,991 | B1 | 5/2003 | Kotliar |
| 6,662,549 | B2 | 12/2003 | Burns |
| 6,742,721 | B2 | 6/2004 | Piper |
| 6,900,246 | B2 | 5/2005 | List et al. |
| 7,080,793 | B2 | 7/2006 | Borisov et al. |
| 7,111,975 | B2 | 9/2006 | Fenton et al. |
| 7,216,722 | B2 | 5/2007 | Sharma et al. |
| 2004/0188104 | A1 | 9/2004 | Borisov et al. |
| 2004/0195364 | A1 | 10/2004 | Piper |
| 2006/0278410 | A1 | 12/2006 | Reilly et al. |
| 2006/0278736 | A1 | 12/2006 | Reilly et al. |
| 2008/0105442 | A1 | 5/2008 | Reilly et al. |

FOREIGN PATENT DOCUMENTS

| | | |
|---|---|---|
| WO | WO 00/41769 | 7/2000 |
| WO | WO 03/030995 | 4/2003 |

OTHER PUBLICATIONS

PCT/US06/23013, Dec. 2006, ISR/Written Opinion.
PCT/US06/23013, Jun. 2005, Intnatl. Prelim Report on Patentability.
PCT/US07/22873, Jul. 2008, ISR/Written Opinion.
PCT/US07/22873, May 2009, Intnatl. Prelim. Report on Patentability.
PCT/US06/23014, Apr. 2009, Intnatl. Prelim. Report on Patentability.
PCT/US06/23014, Jul. 2008, ISR/Written Opinion.

HIGH VELOCITY LOW PRESSURE EMITTER WITH DEFLECTOR HAVING CLOSED END CAVITY

CROSS-REFERENCE TO RELATED APPLICATIONS

This application is based on and claims priority to U.S. application Ser. No. 11/451,795, filed Jun. 13, 2006 which is based on and claims priority to U.S. Provisional Application No. 60/689,864, filed Jun. 13, 2005 and U.S. Provisional Application No. 60/776,407, filed Feb. 24, 2006.

FIELD OF THE INVENTION

This invention concerns devices for emitting atomized liquid, the device injecting the liquid into a gas flow stream where the liquid is atomized and projected away from the device.

BACKGROUND OF THE INVENTION

Devices such as resonance tubes are used to atomize liquids for various purposes. The liquids may be fuel, for example, injected into a jet engine or rocket motor or water, sprayed from a sprinkler head in a fire suppression system. Resonance tubes use acoustic energy, generated by an oscillatory pressure wave interaction between a gas jet and a cavity, to atomize liquid that is injected into the region near the resonance tube where the acoustic energy is present.

Resonance tubes of known design and operational mode generally do not have the fluid flow characteristics required to be effective in fire protection applications. The volume of flow from the resonance tube tends to be inadequate, and the water particles generated by the atomization process have relatively low velocities. As a result, these water particles are decelerated significantly within about 8 to 16 inches of the sprinkler head and cannot overcome the plume of rising combustion gas generated by a fire. Thus, the water particles cannot get to the fire source for effective fire suppression. Furthermore, the water particle size generated by the atomization is ineffective at reducing the oxygen content to suppress a fire if the ambient temperature is below 55° C. Additionally, known resonance tubes require relatively large gas volumes delivered at high pressure. This produces unstable gas flow which generates significant acoustic energy and separates from deflector surfaces across which it travels, leading to inefficient atomization of the water. There is clearly a need for an atomizing emitter that operates more efficiently than known resonance tubes in that the emitter uses smaller volumes of gas at lower pressures to produce sufficient volume of atomized water particles having a smaller size distribution while maintaining significant momentum upon discharge so that the water particles may overcome the fire smoke plume and be more effective at fire suppression.

SUMMARY OF THE INVENTION

The invention concerns an emitter for atomizing and discharging a liquid entrained in a gas stream. The emitter is connectable in fluid communication with a pressurized source of the liquid and a pressurized source of the gas. The emitter comprises a nozzle having an inlet and an outlet and an unobstructed bore therebetween. The outlet has a diameter, and the inlet is connectable in fluid communication with the pressurized gas source. A duct, separate from the nozzle, is connectable in fluid communication with the pressurized liquid source. The duct has an exit orifice separate from and positioned adjacent to the nozzle outlet. A deflector surface is positioned facing the nozzle outlet in spaced relation thereto. The deflector surface has a first surface portion comprising a flat surface oriented substantially perpendicularly to the nozzle and a second surface portion which may comprise an angled surface or a curved surface, surrounding the flat surface. The flat surface has a minimum diameter approximately equal to the outlet diameter. The angled surface may have a sweep back angle between about 15° and about 45° measured from the flat surface.

A closed end cavity is positioned within the deflector surface and is surrounded by the flat surface.

The nozzle may be a convergent nozzle. The outlet diameter may be between about ⅛ and about 1 inch. The orifice may have a diameter between about 1/32 and about ⅛ inch. The deflector surface may be spaced from the outlet by a distance between about 1/10 and about ¾ of an inch. The exit orifice may be spaced from the nozzle outlet by a distance between about 1/64 and ⅛ of an inch.

The nozzle may be adapted to operate over a gas pressure range between about 29 psia and about 60 psia, and the duct may be adapted to operate over a liquid pressure range between about 1 psig and about 50 psig.

The duct may be angularly oriented toward the nozzle. The emitter may comprise a plurality of ducts, each of the ducts having a respective exit orifice positioned adjacent to the nozzle outlet. The ducts may be angularly oriented toward the nozzle.

The deflector surface may be positioned so that the gas forms a first shock front between the outlet and the deflector surface, and a second shock front proximate to the deflector surface when the gas is discharged from the outlet. The liquid may be entrained with the gas proximate to either or both of the first and second shock fronts.

DETAILED DESCRIPTION OF THE EMBODIMENTS

Figure 1:
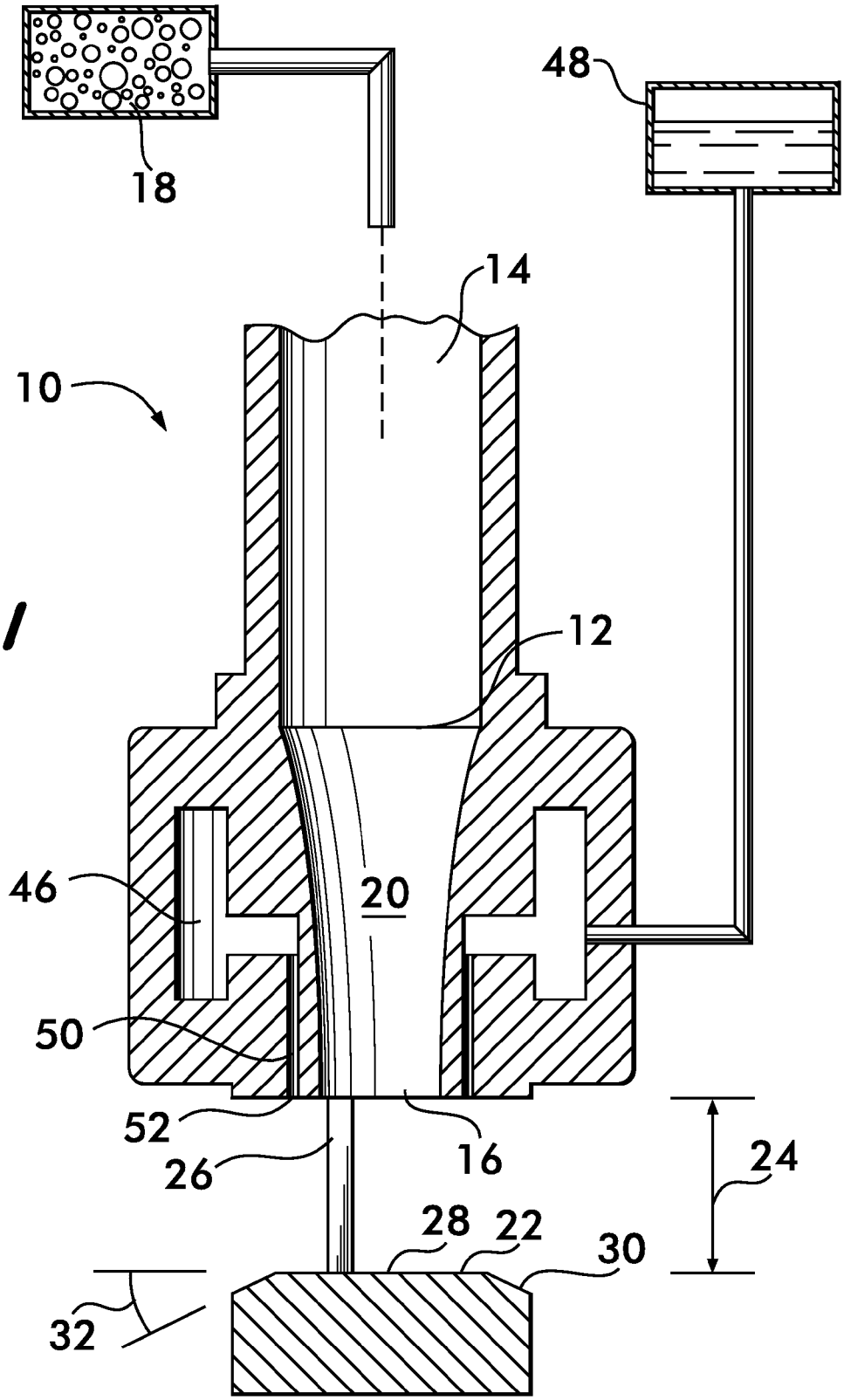
FIG. 1 is a longitudinal sectional view of a high velocity low pressure emitter according to the invention.

FIG. 1 shows a longitudinal sectional view of a high velocity low pressure emitter 10 according to the invention. Emitter 10 comprises a convergent nozzle 12 having an inlet 14 and an outlet 16 and an unobstructed bore therebetween. Outlet 16 may range in diameter between about ⅛ inch to about 1 inch for many applications. Inlet 14 is in fluid communication with a pressurized gas supply 18 that provides gas to the nozzle at a predetermined pressure and flow rate. It is advantageous that the nozzle 12 have a curved convergent inner surface 20, although other shapes, such as a linear tapered surface, are also feasible.

A deflector surface 22 is positioned in spaced apart relation with the nozzle 12, a gap 24 being established between the deflector surface and the nozzle outlet. The gap may range in size between about 1/10 inch to about 3/4 inches. The deflector surface 22 is held in spaced relation from the nozzle by one or more support legs 26.

Preferably, deflector surface 22 comprises a flat surface portion 28 substantially aligned with the nozzle outlet 16, and an angled surface portion 30 contiguous with and surrounding the flat portion. Flat portion 28 is substantially perpendicular to the gas flow from nozzle 12, and has a minimum diameter approximately equal to the diameter of the outlet 16. The angled portion 30 is oriented at a sweep back angle 32 from the flat portion. The sweep back angle may range between about 15° and about 45° and, along with the size of gap 24, determines the dispersion pattern of the flow from the emitter.

Figure 2:
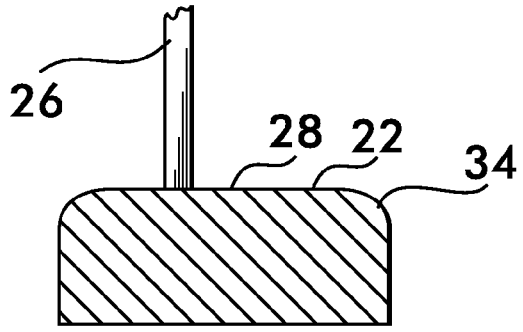
FIG. 2 is a longitudinal sectional view showing a component of the emitter depicted in FIG. 1.
Figure 3:
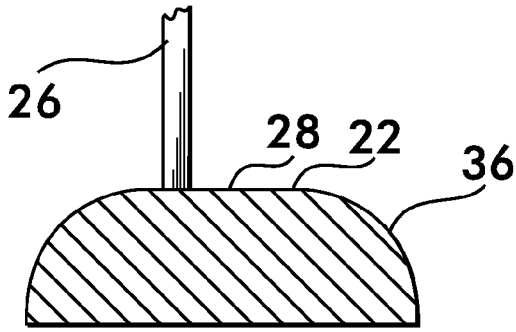
FIG. 3 is a longitudinal sectional view showing a component of the emitter depicted in FIG. 1.
Figure 4:
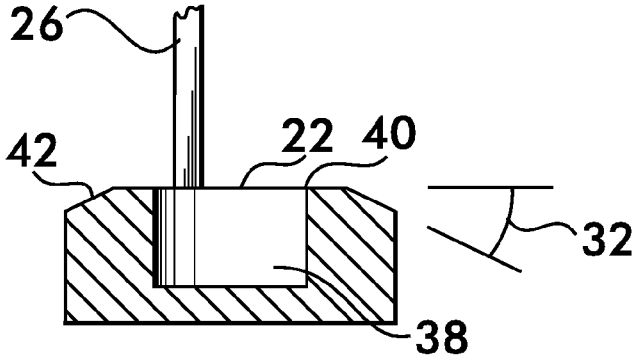
FIG. 4 is a longitudinal sectional view showing a component of the emitter depicted in FIG. 1.
Figure 5:
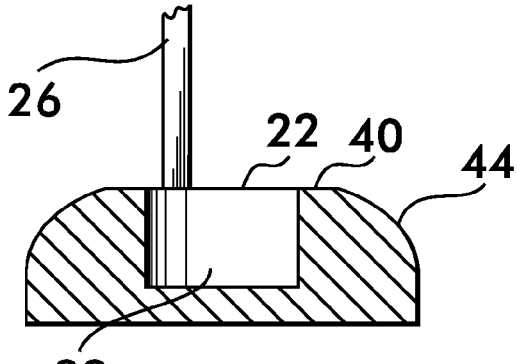
FIG. 5 is a longitudinal sectional view showing a component of the emitter depicted in FIG. 1.

Deflector surface 22 may have other shapes, such as the curved upper edge 34 shown in FIG. 2 and the curved edge 36 shown in FIG. 3. As shown in FIGS. 4 and 5, the deflector surface 22 may also include a closed end cavity 38 surrounded by a flat portion 40 and a swept back, angled portion 42 (FIG. 4) or a curved portion 44 (FIG. 5). The diameter and depth of the cavity may be approximately equal to the diameter of outlet 16.

With reference again to FIG. 1, an annular chamber 46 surrounds nozzle 12. Chamber 46 is in fluid communication with a pressurized liquid supply 48 that provides a liquid to the chamber at a predetermined pressure and flow rate. A plurality of ducts 50 extend from the chamber 46. Each duct has an exit orifice 52 positioned adjacent to nozzle outlet 16. The exit orifices have a diameter between about 1/32 and 1/8 inches. Preferred distances between the nozzle outlet 16 and the exit orifices 52 range between about 1/64 inch to about 1/8 inch as measured along a radius line from the edge of the nozzle outlet to the closest edge of the exit orifice. Liquid, for example, water for fire suppression, flows from the pressurized supply 48 into the chamber 46 and through the ducts 50, exiting from each orifice 52 where it is atomized by the gas flow from the pressurized gas supply that flows through the nozzle 12 and exits through the nozzle outlet 16 as described in detail below.

Emitter 10, when configured for use in a fire suppression system, is designed to operate with a preferred gas pressure between about 29 psia to about 60 psia at the nozzle inlet 14 and a preferred water pressure between about 1 psig and about 50 psig in chamber 46. Feasible gases include nitrogen, other inert gases, mixtures of inert gases as well as mixtures of inert and chemically active gases such as air.

Figure 6:
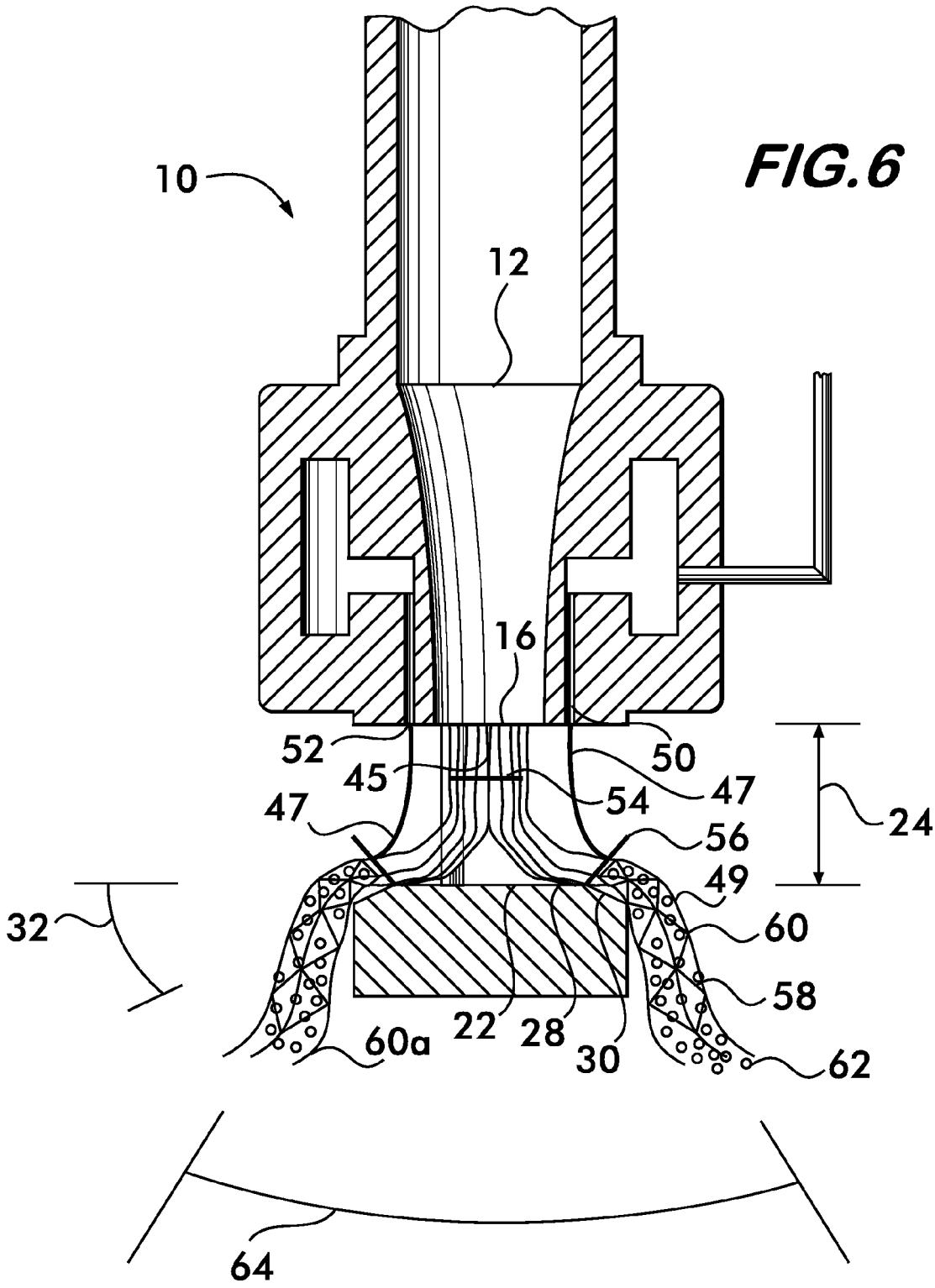
FIG. 6 is a diagram depicting fluid flow from the emitter based upon a Schlieren photograph of the emitter shown in FIG. 1 in operation.

Operation of the emitter 10 is described with reference to FIG. 6 which is a drawing based upon Schlieren photographic analysis of an operating emitter.

Gas 45 exits the nozzle outlet 16 at about Mach 1.5 and impinges on the deflector surface 22. Simultaneously, water 47 is discharged from exit orifices 52.

Interaction between the gas 45 and the deflector surface 22 establishes a first shock front 54 between the nozzle outlet 16 and the deflector surface 22. A shock front is a region of flow transition from supersonic to subsonic velocity. Water 47 exiting the orifices 52 does not enter the region of the first shock front 54.

A second shock front 56 forms proximate to the deflector surface at the border between the flat surface portion 28 and the angled surface portion 30. Water 47 discharged from the orifices 52 is entrained with the gas jet 45 proximate to the second shock front 56 forming a liquid-gas stream 60. One method of entrainment is to use the pressure differential between the pressure in the gas flow jet and the ambient. Shock diamonds 58 form in a region along the angled portion 30, the shock diamonds being confined within the liquid-gas stream 60, which projects outwardly and downwardly from the emitter. The shock diamonds are also transition regions between super and subsonic flow velocity and are the result of the gas flow being overexpanded as it exits the nozzle. Overexpanded flow describes a flow regime wherein the external pressure (i.e., the ambient atmospheric pressure in this case) is higher than the gas exit pressure at the nozzle. This produces oblique shock waves which reflect from the free jet boundary 49 marking the limit between the liquid-gas stream 60 and the ambient atmosphere. The oblique shock waves are reflected toward one another to create the shock diamonds.

Significant shear forces are produced in the liquid-gas stream 60, which ideally does not separate from the deflector surface, although the emitter is still effective if separation occurs as shown at 60*a*. The water entrained proximate to the second shock front 56 is subjected to these shear forces which are the primary mechanism for atomization. The water also encounters the shock diamonds 58, which are a secondary source of water atomization.

Thus, the emitter 10 operates with multiple mechanisms of atomization which produce water particles 62 less than 20 μm in diameter, the majority of the particles being measured at less than 5 μm. The smaller droplets are buoyant in air. This characteristic allows them to maintain proximity to the fire source for greater fire suppression effect. Furthermore, the particles maintain significant downward momentum, allowing the liquid-gas stream 60 to overcome the rising plume of combustion gases resulting from a fire. Measurements show the liquid-gas stream having a velocity of 1,200 ft/min 18 inches from the emitter, and a velocity of 700 ft/min 8 feet from the emitter. The flow from the emitter is observed to impinge on the floor of the room in which it is operated. The sweep back angle 32 of the angled portion 30 of the deflector surface 22 provides significant control over the included angle 64 of the liquid-gas stream 60. Included angles of about 120° are achievable. Additional control over the dispersion pattern of the flow is accomplished by adjusting the gap 24 between the nozzle outlet 16 and the deflector surface.

During emitter operation it is further observed that the smoke layer that accumulates at the ceiling of a room during a fire is drawn into the gas stream 45 exiting the nozzle and is entrained in the flow 60. This adds to the multiple modes of extinguishment characteristic of the emitter as described below.

The emitter causes a temperature drop due to the atomization of the water into the extremely small particle sizes described above. This absorbs heat and helps mitigate spread of combustion. The nitrogen gas flow and the water entrained in the flow replace the oxygen in the room with gases that cannot support combustion. Further oxygen depleted gases in the form of the smoke layer that is entrained in the flow also contributes to the oxygen starvation of the fire. It is observed, however, that the oxygen level in the room where the emitter is deployed does not drop below about 16%. The water particles and the entrained smoke create a fog that blocks radiative heat transfer from the fire, thus mitigating spread of combustion by this mode of heat transfer. Because of the extraordinary large surface area resulting from the extremely small water particle size, the water readily absorbs energy and forms steam which further displaces oxygen, absorbs heat from the fire and helps maintain a stable temperature typically associated with a phase transition. The mixing and the turbulence created by the emitter also helps lower the temperature in the region around the fire.

The emitter is unlike resonance tubes in that it does not produce significant acoustic energy. Jet noise (the sound generated by air moving over an object) is the only acoustic output from the emitter. The emitter's jet noise has no significant frequency components higher than about 6 kHz (half the operating frequency of well known types of resonance tubes) and does not contribute significantly to water atomization.

Furthermore, the flow from the emitter is stable and does not separate from the deflector surface (or experiences delayed separation as shown at 60*a*) unlike the flow from resonance tubes, which is unstable and separates from the deflector surface, thus leading to inefficient atomization or even loss of atomization.

Figure 7:
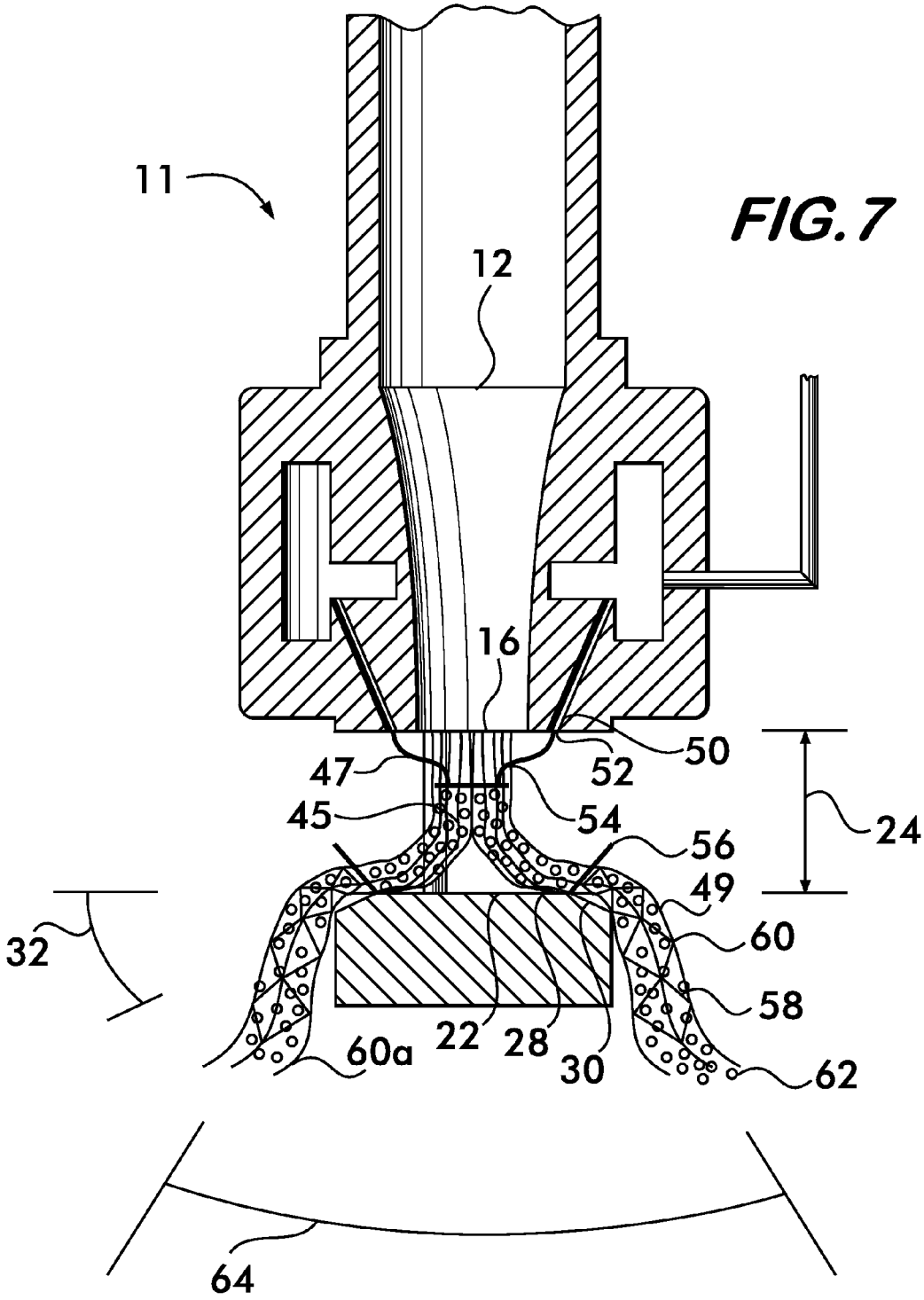
FIG. 7 is a diagram depicting predicted fluid flow for another embodiment of the emitter.

Another emitter embodiment 11 is shown in FIG. 7. Emitter 11 has ducts 50 that are angularly oriented toward the nozzle 12. The ducts are angularly oriented to direct the water or other liquid 47 toward the gas 45 so as to entrain the liquid in the gas proximate to the first shock front 54. It is believed that this arrangement will add yet another region of atomization in the creation of the liquid-gas stream 60 projected from the emitter 11.

Emitters according to the invention operated so as to produce an overexpanded gas jet with multiple shock fronts and shock diamonds achieve multiple stages of atomization and result in multiple extinguishment modes being applied to control the spread of fire when used in a fire suppression system.

What is claimed is:

1. An emitter for atomizing and discharging a liquid entrained in a gas stream, said emitter being connectable in fluid communication with a pressurized source of said liquid and a pressurized source of said gas, said emitter comprising:

a nozzle having an inlet and an outlet and an unobstructed bore therebetween, said outlet having a diameter, said inlet being connectable in fluid communication with said pressurized gas source;

a duct, separate from said nozzle and connectable in fluid communication with said pressurized liquid source, said duct having an exit orifice separate from and positioned adjacent to said nozzle outlet; and a deflector surface positioned facing said nozzle outlet in spaced relation thereto, said deflector surface having a first surface portion comprising a flat surface oriented substantially perpendicularly to said nozzle and a second surface portion comprising an angled surface surrounding said flat surface, said flat surface having a minimum diameter approximately equal to said outlet diameter; and a closed end cavity positioned within said deflector surface and surrounded by said flat surface.

2. The emitter according to claim 1, wherein said nozzle is a convergent nozzle.

3. The emitter according to claim 1, wherein said outlet diameter is between about ⅛ and about 1 inch.

4. The emitter according to claim 1, wherein said orifice has a diameter between about 1/32 and about ⅛ inch.

5. The emitter according to claim 1, wherein said deflector surface is spaced from said outlet by a distance between about 1/10 and about ¾ of an inch.

6. The emitter according to claim 1, wherein said exit orifice is spaced from said nozzle outlet by a distance between about 1/64 and ⅛ of an inch.

7. The emitter according to claim 1, wherein said nozzle is adapted to operate over a gas pressure range between about 29 psia and about 60 psia.

8. The emitter according to claim 1, wherein said duct is adapted to operate over a liquid pressure range between about 1 psig and about 50 psig.

9. The emitter according to claim 1, wherein said duct is angularly oriented toward said nozzle.

10. The emitter according to claim 1, further comprising a plurality of said ducts, each of said ducts having a respective exit orifice positioned adjacent to said nozzle outlet.

11. The emitter according to claim 10, wherein said ducts are angularly oriented toward said nozzle.

12. The emitter according to claim 1, wherein said deflector surface is positioned so that said gas forms a first shock front between said outlet and said deflector surface, and a second shock front is formed proximate to said deflector surface when said gas is discharged from said outlet.

13. The emitter according to claim 12, wherein said liquid is entrained with said gas proximate to said first shock front.

14. The emitter according to claim 12, wherein said liquid is entrained with said gas proximate to said second shock front.

15. The emitter according to claim 1, wherein said angled surface has a sweep back angle between about 15° and about 45° measured from said flat surface.

16. An emitter for atomizing and discharging a liquid entrained in a gas stream, said emitter being connectable in fluid communication with a pressurized source of said liquid and a pressurized source of said gas, said emitter comprising:

a nozzle having an inlet and an outlet and an unobstructed bore therebetween, said outlet having a diameter, said inlet being connectable in fluid communication with said pressurized gas source;

a duct, separate from said nozzle and connectable in fluid communication with said pressurized liquid source, said duct having an exit orifice separate from and positioned adjacent to said nozzle outlet; and a deflector surface positioned facing said nozzle outlet in spaced relation thereto, said deflector surface having a first surface portion comprising a flat surface oriented substantially perpendicularly to said nozzle and a second surface portion comprising curved surface surrounding said flat surface, said flat surface having a minimum diameter approximately equal to said outlet diameter; and a closed end cavity positioned within said deflector surface and surrounded by said flat surface.

17. The emitter according to claim 16, wherein said nozzle is a convergent nozzle.

18. The emitter according to claim 16, wherein said outlet diameter is between about ⅛ and about 1 inch.

19. The emitter according to claim 16, wherein said orifice has a diameter between about 1/32 and about ⅛ inch.

20. The emitter according to claim 16, wherein said deflector surface is spaced from said outlet by a distance between about 1/10 and about ¾ of an inch.

21. The emitter according to claim 16, wherein said exit orifice is spaced from said nozzle outlet by a distance between about 1/64 and ⅛ of an inch.

22. The emitter according to claim 16, wherein said nozzle is adapted to operate over a gas pressure range between about 29 psia and about 60 psia.

23. The emitter according to claim 16, wherein said duct is adapted to operate over a liquid pressure range between about 1 psig and about 50 psig.

24. The emitter according to claim 16, wherein said duct is angularly oriented toward said nozzle.

25. The emitter according to claim 16, wherein said duct is angularly oriented toward said nozzle.

26. The emitter according to claim 16, further comprising a plurality of said ducts, each of said ducts having a respective exit orifice positioned adjacent to said nozzle outlet.

27. The emitter according to claim 26, wherein said ducts are angularly oriented toward said nozzle.

28. The emitter according to claim 16, wherein said deflector surface is positioned so that said gas forms a first shock front between said outlet and said deflector surface, and a second shock front is formed proximate to said deflector surface when said gas is discharged from said outlet.

29. The emitter according to claim 28, wherein said liquid is entrained with said gas proximate to said first shock front.

30. The emitter according to claim 28, wherein said liquid is entrained with said gas proximate to said second shock front.

* * * * *